US005450969A

United States Patent [19]

Johnson et al.

[11] Patent Number: 5,450,969

[45] Date of Patent: Sep. 19, 1995

[54] SHELVING DISPLAY

[75] Inventors: Terry Johnson, Chicago; John Schoemer, Schaumburg, both of Ill.

[73] Assignee: Gamon International, Inc., Elk Grove Village, Ill.

[21] Appl. No.: 150,359

[22] Filed: Nov. 8, 1993

[51] Int. Cl.[6] ..... A47F 1/04

[52] U.S. Cl. ..... 211/59.3; 312/71

[58] Field of Search ..... 211/59.3, 51, 184; 108/60, 61; 312/71

[56] References Cited

U.S. PATENT DOCUMENTS

| | | | |
|---|---|---|---|
| 3,487,945 | 1/1970 | Barham | 211/184 X |
| 3,780,873 | 12/1973 | Silva | 211/59.3 |
| 4,303,162 | 12/1981 | Suttles | 211/59.3 |
| 4,730,741 | 3/1988 | Jackle, III et al. | 312/71 X |
| 4,830,201 | 5/1989 | Breslow | 211/59.3 |
| 4,836,390 | 6/1989 | Polvere | 211/59.3 |
| 4,907,707 | 3/1990 | Crum | 211/59.3 |
| 5,012,936 | 5/1991 | Crum | 211/59.3 |
| 5,069,349 | 12/1991 | Wear et al. | 211/59.3 |

*Primary Examiner*—Ramon O. Ramirez
*Assistant Examiner*—Korie H. Chan
*Attorney, Agent, or Firm*—Douglas B. White

[57] ABSTRACT

This display includes a backing plate arranged to ride on a track, and employs a coil spring bias to urge the backing plate toward the forward edge of the display. The backing plate includes a slot engaging groove to ride the track under the spring bias and to limit rearward motion. At the rear of the display, the track exhibits a locking edge which engages the plate member to hold the plate at the rear while the display is loaded.

6 Claims, 4 Drawing Sheets

SHELVING DISPLAY

BACKGROUND OF THE INVENTION

1. Field of the Invention

The invention relates generally to shelving adapted to display product, and more particularly to shelving designed to maintain a stack of product and present it at the forward edge of the shelf.

2. Description of the Prior Art

Shelving display apparatus is used in conjunction with, or in place of, existing shelves to display product, such as packaged food. These displays accept stacks of product, placed one behind the other, and bias the stack forwardly through pressure applied by a backing plate positioned behind the stack. In the prior art the mechanism for applying this forward pressure and for controlling the plate member has been complex, resulting in an expensive display which is difficult to handle and inefficient to load.

SUMMARY OF THE INVENTION

Accordingly, it is the principal objective of the present invention to provide a shelving display which is easy to operate and easy to load, promotes rotation of inventory, and does not involve complicated mechanical apparatus.

This display includes a backing plate having a groove integral therewith and arranged to ride on a track under a coil spring bias to maintain the stack of product at the forward edge of the display. At the rear of the display the track exhibits a locking edge which selectively engages the groove of the backing plate to hold the plate at the rear while the display is loaded.

While the invention will be described in connection with a preferred embodiment, it will be understood that it is not the intent to limit the invention to that embodiment. On the contrary, it is the intent to cover all alternatives, modifications, and equivalents as may be included within the spirit and scope of the invention as defined by the appended claims.

DESCRIPTION OF THE PREFERRED EMBODIMENT

Figure 1:
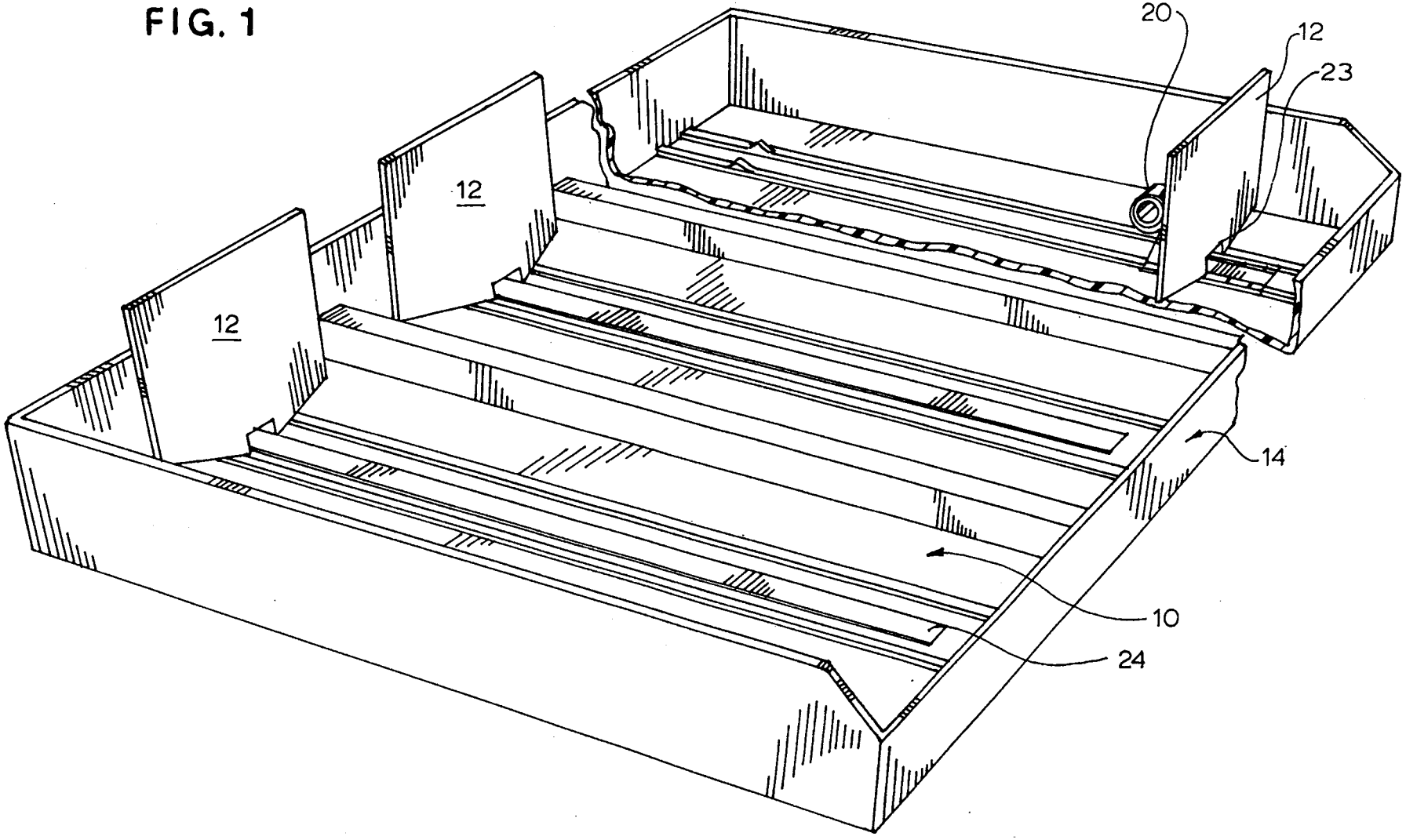
FIG. 1 is a perspective view of the shelving display of the present invention showing multiple tracks for stacking of inventory.
Figure 2:
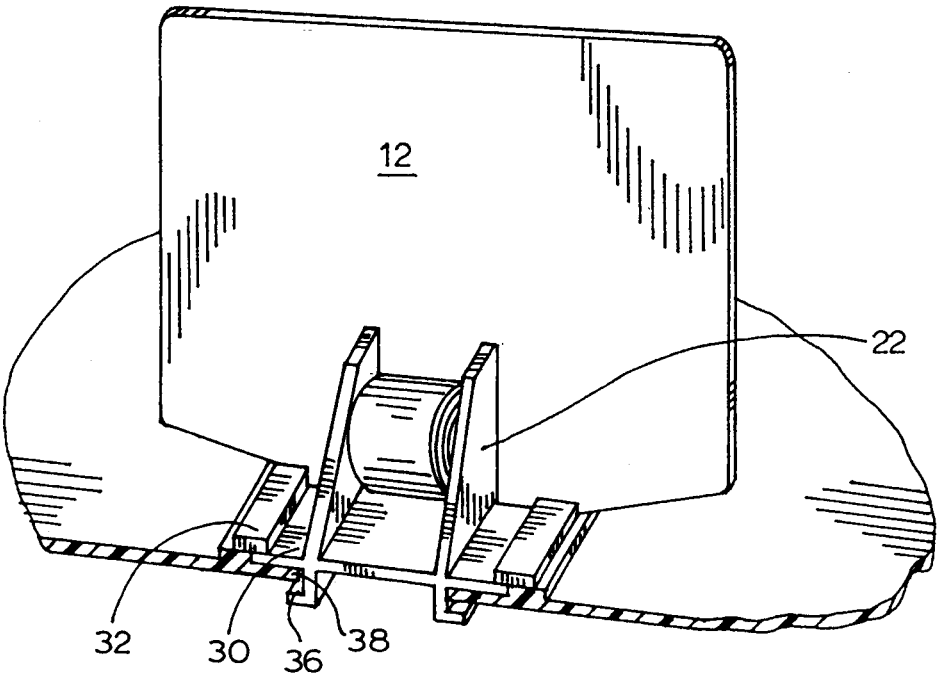
FIG. 2 is a rear view of the moveable plate and track from a single track of the shelving display.
Figure 3:
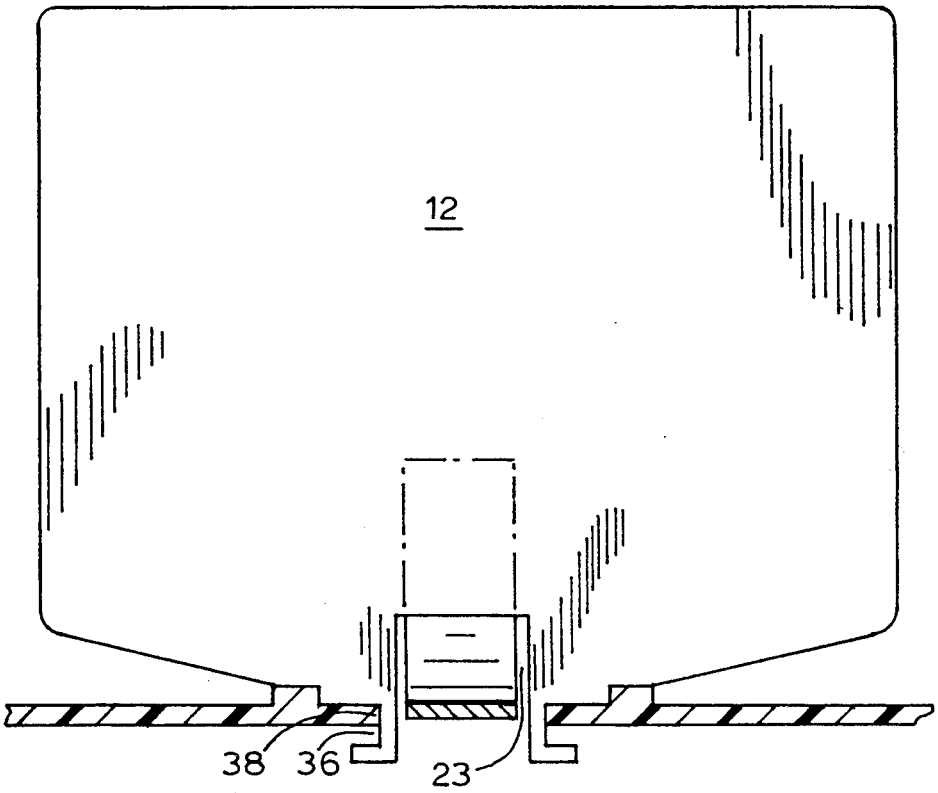
FIG. 3 is a front view of the moveable plate and track from a single track of the shelving display.

Turning to FIGS. 1–3, there is shown a shelving display in accordance with the present invention. Generally this display includes one or more elongated slots in the display base forming tracks 10 upon which a backing plate 12 moves to position inventory toward the forward edge 14 of the display.

The backing plate is forwardly biased by a coiled spring 20 contained between vertical supports 22 (FIG. 2) positioned behind the backing plate. The coil spring comprises a coiled metal band with one end of the coil extending through an opening 23 in the plate to an anchor 24 near the front of the display. The lower portion of the backing plate extends flanges 32 rearwardly above and below the display base, which flanges cooperate to form a groove 36 for slidably engaging the edges 38 defined by the sides of the slot in the display base.

Figure 4:
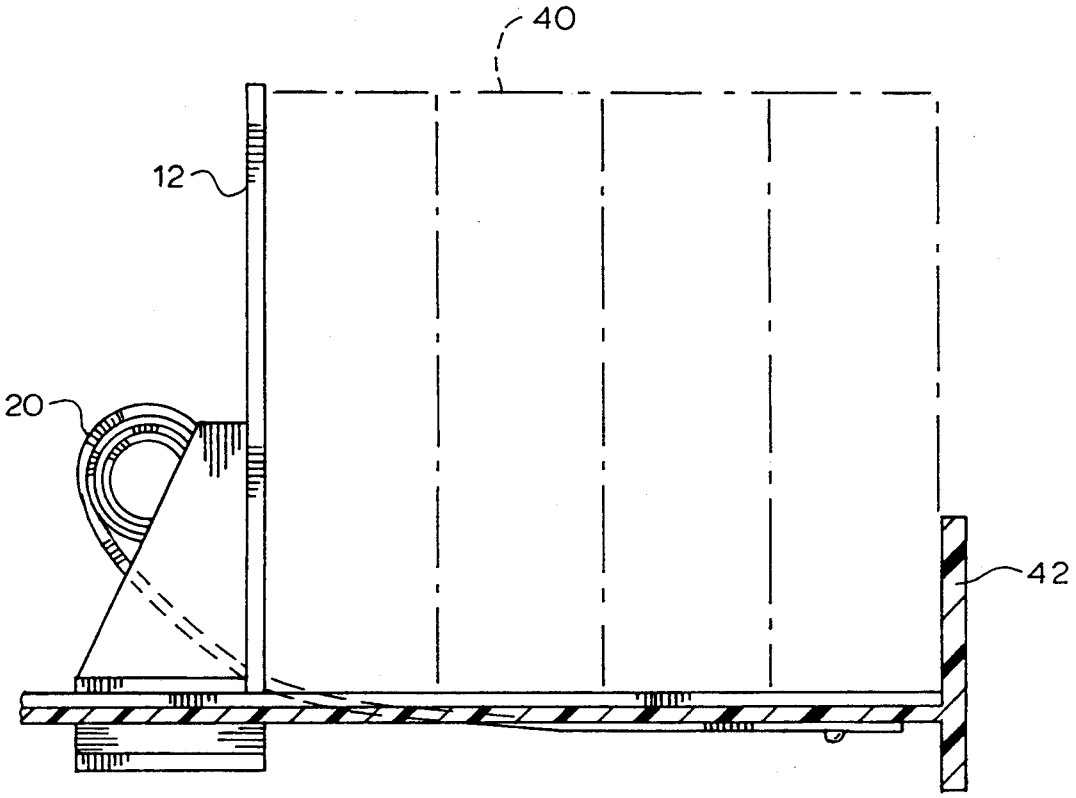
FIG. 4 is a cross-section of a single track of the shelving display showing inventory stacked therein.

When displaying product (FIG. 4) a stack of packages 40 is positioned between the backing plate and the front lip 42 of the display, and the coil spring through its coiling action acts to urge the stack forwardly towards the lip 42. Removal of a package results in a forward shift of the remainder of the stack, as the backing plate is pulled forward by the coiling of the coil spring.

Figure 5:
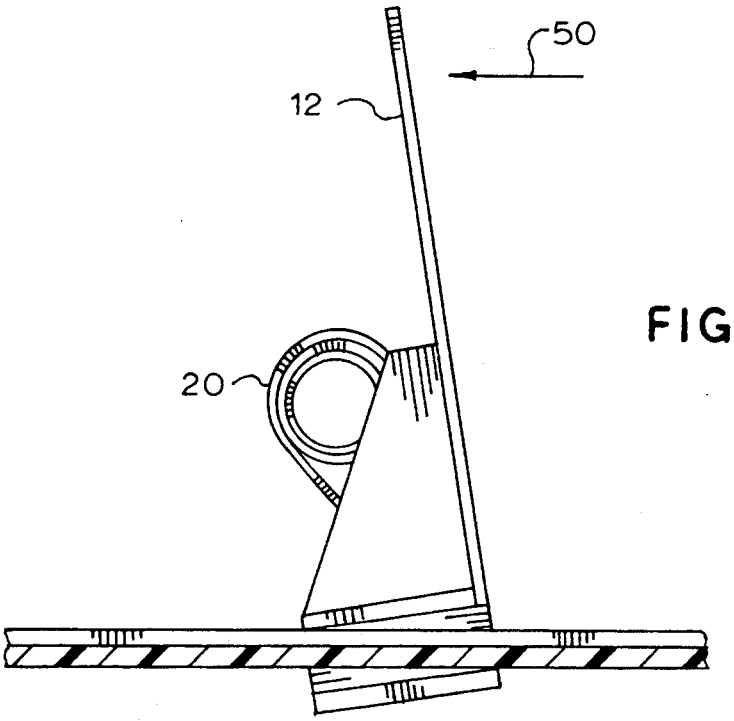
FIG. 5 is a cross-section of a single track of the shelving display depicting a frictional lock when pressure is applied high on the back plate.
Figure 6:
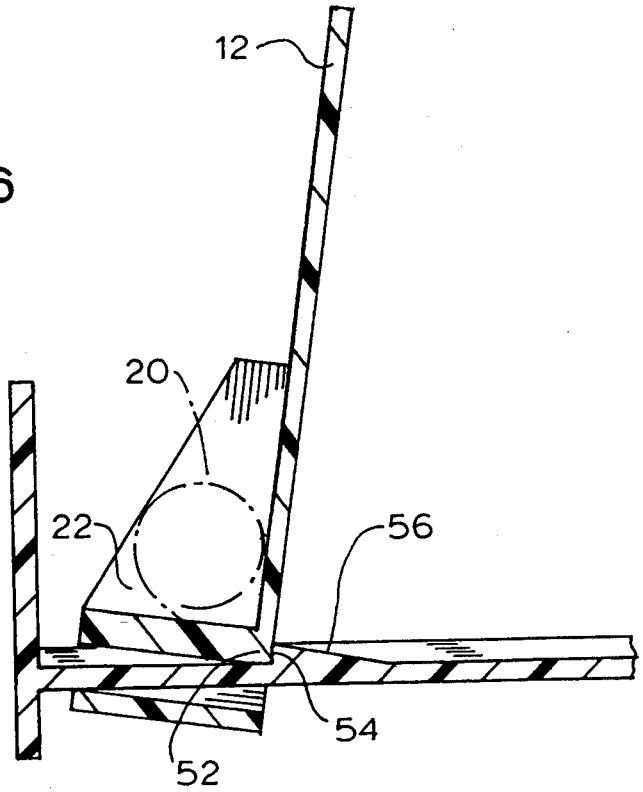
FIG. 6 is a cross-section of a single track of the shelving display depicting the locking edge at the rear of the track.

When loading the display it is desirable to first remove old stock and to place it in front of new stock. To encourage this stock rotation the design of the present invention causes the backing plate to lock against the track when rearward pressure is applied to the stack of packages. Since the frictional resistance against the backing plate resulting from the stack of packages and the force of the spring are sufficiently coincident with the track, the backing plate remains vertical during normal use and does not bind or lock against the track. But as shown in FIG. 5, binding will result when pressure 50 is applied to the upper portion of the plate, such as would result from pressure applied to a stack of old product left in the display. This requires the employee to first remove the old stock and then to push the backing plate rearward by applying pressure at its base.

Figure 7:
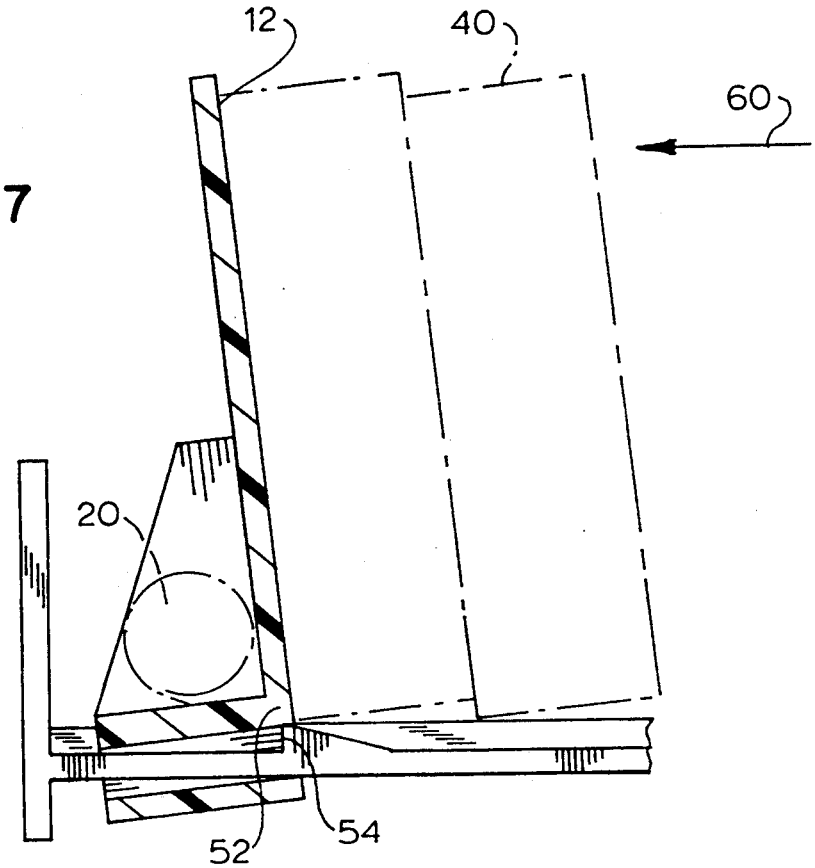
FIG. 7 is a cross-section of a single track of the shelving display showing release from the locking edge following loading of the inventory.

When the backing plate is pushed to the rearward end of the track a locking edge 54 engages the base 52 of the backing plate. During rearward movement of the backing plate a ramp 56 guides it over this locking edge, and the bias of the coil spring acts to pull the backing plate forwardly to abut its base against the locking edge. After the loading of a stack of packages, a rearward force 60 applied to the packages (FIG. 7) causes the backing plate to tilt rearwardly. This causes the base of the backing plate to rise sufficiently to clear the locking edge and to thereafter bias the stack forwardly as described above.

From the foregoing description, it will be apparent that modifications can be made to the apparatus and method for using same without departing from the teachings of the present invention. Accordingly, the scope of the invention is only to be limited as necessitated by the accompanying claims.

We claim:

1. A shelving display for presenting a stack of inventory comprising:

a base of said display having a track defined thereon, said track comprising a slot in said base of said display;

a movable plate member slidably engaged at a base thereof with said track for providing forwardly biased support to a stack of inventory, said sliding engagement comprising a slot engaging groove integral with said base of said moveable plate member; wherein said slot engaging groove permitting said movable plate to tilt on said track to arrest sliding movement of the movable plate means for urging said moveable plate member forwardly;

latch means defined fixedly on to said track for engaging said moveable plate member and preventing forward motion thereof; and a ramp defined fixedly on to said track for guiding said moveable plate member past said latch means during rearward motion of said moveable plate member.

2. The shelving display for presenting a stack of inventory of claim 1 wherein said means for urging said plate member forwardly includes a coiled spring positioned to coil behind said plate member proximate said base thereof and affixed at one end to the forward edge of said base of said display.

3. The shelving display for presenting a stock of inventory of claim 2 further comprising means for selectively disengaging said latch means.

4. A shelving display for presenting a plurality of stacks of inventory comprising:

a base of said display having a plurality of tracks defined thereon, wherein a respective one of said tracks comprises a slot in said base of said display;

movable plate members each slidably engaged at a base thereof with said tracks for providing forwardly biased support to stacks of inventory, said sliding engagement comprising a slot engaging groove integral with said base of a respective one of said moveable plate members; wherein said slot engaging groove permitting said movable plate to tilt on said track to arrest sliding movement of the movable plate means for urging said moveable plate members forwardly; and latch means defined fixedly on a respective one of said tracks for engaging a respective one of said moveable plate members and preventing forward motion thereof; and a ramp defined fixedly on said track for guiding said moveable plate member past said latch means during rearward motion of said moveable plate member.

5. The shelving display for presenting a plurality of stacks of inventory of claim 4 wherein said means for urging a respective one of said moveable plate members forwardly includes a coiled spring positioned to coil behind said moveable plate member proximate said base thereof and affixed at one end to the forward edge of said base of said display.

6. The shelving display for presenting a stock of inventory of claim 5 further comprising means for selectively disengaging said latch means.

* * * * *